US012435474B2

(12) United States Patent
Gibson, II et al.

(10) Patent No.: US 12,435,474 B2
(45) Date of Patent: Oct. 7, 2025

(54) AUTO STOW WINGS

(71) Applicant: Progress Rail Services Corporation, Albertville, AL (US)

(72) Inventors: Gary K. Gibson, II, Wetumpka, AL (US); Michael D. Adams, Prattville, AL (US); Alston H. Pike, Wetumpka, AL (US)

(73) Assignee: Progress Rail Services Corporation, Albertville, AL (US)

( * ) Notice: Subject to any disclaimer, the term of this patent is extended or adjusted under 35 U.S.C. 154(b) by 947 days.

(21) Appl. No.: 17/570,119

(22) Filed: Jan. 6, 2022

(65) Prior Publication Data

US 2023/0212828 A1 Jul. 6, 2023

(51) Int. Cl.
*E01B 27/02* (2006.01)

(52) U.S. Cl.
CPC ..... *E01B 27/02* (2013.01)

(58) Field of Classification Search
CPC ..... E01B 27/02; E01B 27/021; E01B 27/022; E01B 27/023; E01B 27/06; E01B 27/10; E01B 27/11; E01B 27/20
See application file for complete search history.

(56) References Cited

U.S. PATENT DOCUMENTS

| | | | | |
|---|---|---|---|---|
| 1,328,489 | A | 1/1920 | Bressler | |
| 5,284,097 | A * | 2/1994 | Peppin | E01B 27/02 246/187 A |
| 6,883,436 | B2 | 4/2005 | Fuerst | |
| 9,127,412 | B2 | 9/2015 | Spurlock et al. | |
| 2004/0237829 | A1 * | 12/2004 | Fuerst | E01B 27/02 104/7.1 |

OTHER PUBLICATIONS

Knox Kershaw Inc.; "KBR 925 Wing Auto Store", Sep. 10, 2020, youtube.com/watch?v=otPdoVuKe5Q, (3 pages with 6 screen printed images from video).
Knox Kershaw Inc.; "KBR 925 Ballast Regulator", Oct. 18, 2013, youtube.com/watch?v=6DzNDrDsWwk, (3 pages with 6 screen printed images from video).

* cited by examiner

*Primary Examiner* — Robert J McCarry, Jr.

(57) ABSTRACT

Automated storage is provide for a ballast wing mounted on a regulator frame of a ballast regulator machine. A machine controller may detect actuation of a wing activation switch and, in response, actuate a wing lift cylinder connected between the regulator frame and a wing arm to dispose the wing arm within a predetermined safe zone, actuate a wing pivot cylinder to rotate a wing frame to a wing frame stored position, actuate a wing extension cylinder to retract the wing arm extension to a retracted position within the wing arm, and actuate the wing lift cylinder to rotate the ballast wing to a stored position adjacent the regulator frame.

17 Claims, 8 Drawing Sheets

AUTO STOW WINGS

TECHNICAL FIELD

The present disclosure relates generally to ballast regulator machines for rail track maintenance and, more particularly, to automated stowage and deployment of wings of ballast regulator machines.

BACKGROUND

Ballast regulator machines, also known as ballast spreaders or ballast sweepers, are rail transport maintenance-of-way equipment used to shape and distribute gravel track ballast that supports the ties and rail tracks. The ballast regulator machines are often used in conjunction with ballast tampers when maintaining railway track. Track ballast gradually shifts over time from natural forces and as a result of the passage of trains. If shifting of the ballast is not addressed, the quality of the track will decrease over time and result in a less smooth ride for trains. Unregulated ballast may also result in the rails shifting out of alignment, which in the worst cases can lead to derailments. Conversely, regular maintenance of ballast can prolong the life of railroad tracks. For these reasons, railroads use ballast regulator machines to maintain the shape and distribution of track ballast. Ballast regulator machines are also used during major track reconstruction. When tracks are rebuilt, new ballast will be dumped along the tracks from hopper cars, and then shaped by the ballast regulator machine.

Typical ballast regulator machines have three types of equipment: plow blades, rotating brushes, and ballast wings. The plow blades are used to move and shape ballast, often after it has been dropped on the tracks by a ballast train. Each of a pair of plow blades may be double sided and at an angle away from the regulator machine itself. The plow blades sculpt the ballast to the proper height, spread it evenly along the tracks and ties, and ensure it is not too high. After the plow blades level and shape the ballast, the rotating brushes may be lowered onto the ties and sweep away ballast, leaving the tops of the ties clear and visible for inspection. The ballast wings serve two purposes: move ballast that is far away from the tracks closer toward the centerline of the tracks, and contour the ballast to slope downwards away from the tracks perpendicularly. Like the plow blades, the ballast wings can be adjusted and moved independently of each other as needed. An example of a ballasting wing assembly for a ballast regulator machine is provided in U.S. Pat. No. 6,883,436, that issued to Fuerst on Apr. 26, 2005.

When the ballast wings are not in use, they may be retracted and stowed proximate a frame of the ballast regulator machine. As the ballast wings are stowed, it may be necessary that each component be in a specific position. It can be difficult for inexperienced operators to move the components in sequence to properly store the ballast wings. If the components are not in the correct position during stowage, damage may occur to the ballast wing, the ballast regulator machine, or both.

SUMMARY OF THE DISCLOSURE

In one aspect of the present disclosure, a ballast regulator machine is disclosed. The ballast regulator machine may include a regulator frame, a ballast wing, a wing activation switch and a machine controller. The ballast wing may include a wing arm pivotally mounted to the regulator frame, a wing arm extension movably mounted to the wing arm for extension away from and retraction toward the regulator frame, a wing frame pivotally mounted to an end of the wing arm extension opposite the regulator frame, a wing lift cylinder having a wing lift cylinder actuator and connected between the regulator frame and the wing arm, a wing pivot cylinder having a wing pivot cylinder actuator and connected between the wing arm extension and the wing frame, and a wing extension cylinder having a wing extension cylinder actuator and connected between the wing arm and the wing arm extension. The machine controller may be operatively connected to the wing lift cylinder actuator, the wing pivot cylinder actuator, the wing extension cylinder actuator and the wing activation switch. The machine controller may be programmed to detect actuation of the wing activation switch, actuate the wing lift cylinder actuator to cause the wing lift cylinder to dispose the wing arm within a predetermined safe zone in response to detecting actuation of the wing activation switch, actuate the wing pivot cylinder actuator to cause the wing lift cylinder to rotate the wing frame to a wing frame stored position after the wing arm is within the predetermined safe zone, actuate the wing extension cylinder actuator to cause the wing extension cylinder to retract the wing arm extension to a retracted position after the wing frame is in the wing frame stored position, and actuate the wing lift cylinder actuator to cause the wing lift cylinder to rotate the ballast wing to a stored position adjacent the regulator frame after the wing arm extension is in the retracted position.

In another aspect of the present disclosure, a method for automated storage of a ballast wing of a ballast regulator machine is disclosed. The ballast regulator machine may include a regulator frame, and the ballast wing may include a wing arm pivotally mounted to the regulator frame, a wing arm extension movably mounted to the wing arm for extension away from and retraction toward the regulator frame, and a wing frame pivotally mounted to an end of the wing arm extension opposite the regulator frame. The method for automated storage may include detecting, by a machine controller of the ballast regulator machine, actuation of a wing activation switch, actuating, by the machine controller, a wing lift cylinder connected between the regulator frame and the wing arm to dispose the wing arm within a predetermined safe zone in response to detecting actuation of the wing activation switch, actuating, by the machine controller, a wing pivot cylinder connected between the wing arm extension and the wing frame to rotate the wing frame to a wing frame stored position after the wing arm is within the predetermined safe zone, actuating, by the machine controller, a wing extension cylinder connected between the wing arm and the wing arm extension to retract the wing arm extension to a retracted position after the wing frame is in the wing frame stored position, and actuating, by the machine controller, the wing lift cylinder to rotate the ballast wing to a stored position adjacent the regulator frame after the wing arm extension is in the retracted position.

In a further aspect of the present disclosure, a ballast regulator machine is disclosed. The ballast regulator machine may include a regulator frame, a ballast wing, a wing activation switch and a machine controller. The ballast wing may include a wing arm pivotally mounted to the regulator frame, a wing arm extension movably mounted to the wing arm for extension away from and retraction toward the regulator frame, a wing frame pivotally mounted to an end of the wing arm extension opposite the regulator frame, a wing lift cylinder having a wing lift cylinder actuator and a wing lift cylinder position sensor, and connected between the regulator frame and the wing arm, a wing pivot cylinder having a wing pivot cylinder actuator and a wing pivot cylinder position sensor, and connected between the wing arm extension and the wing frame, and a wing extension cylinder having a wing extension cylinder actuator and a wing extension cylinder position sensor, and connected between the wing arm and the wing arm extension. The machine controller may be operatively connected to the wing lift cylinder actuator, the wing lift cylinder position sensor, the wing pivot cylinder actuator, the wing pivot cylinder position sensor, the wing extension cylinder actuator, the wing extension cylinder position sensor and the wing activation switch. The machine controller may be programmed to detect actuation of the wing activation switch, actuate the wing lift cylinder actuator to cause the wing lift cylinder to dispose the wing arm within a predetermined safe zone as indicated by the wing lift cylinder position sensor in response to detecting actuation of the wing activation switch, actuate the wing pivot cylinder actuator to cause the wing lift cylinder to rotate the wing frame to a wing frame stored position as indicated by the wing pivot cylinder position sensor after the wing arm is within the predetermined safe zone, actuate the wing extension cylinder actuator to cause the wing extension cylinder to retract the wing arm extension to a retracted position as indicated by the wing extension cylinder position sensor after the wing frame is in the wing frame stored position, and actuate the wing lift cylinder actuator to cause the wing lift cylinder to rotate the ballast wing to a stored position adjacent the regulator frame as indicated by the wing lift cylinder position sensor after the wing arm extension is in the retracted position.

Additional aspects are defined by the claims of this patent.

DETAILED DESCRIPTION

Figure 1:
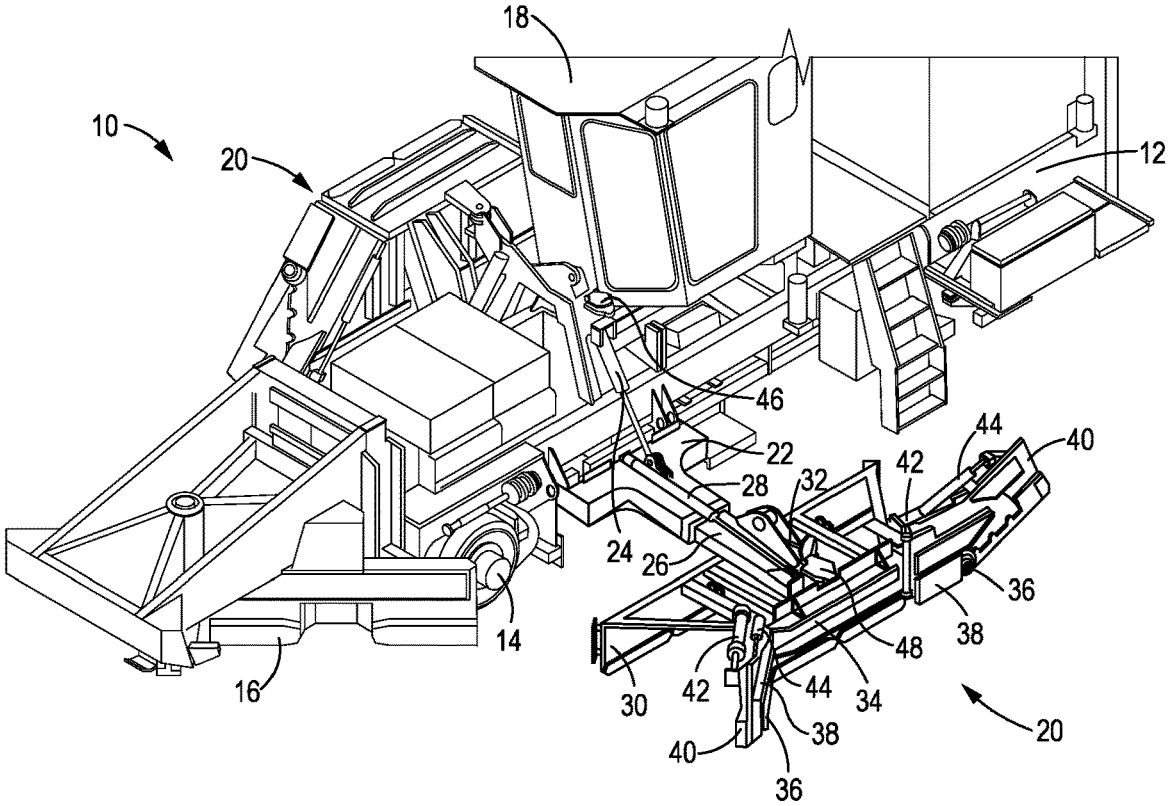
FIG. 1 is an isometric view of a ballast regulator machine in which automated ballast wing storage and deployment in accordance with the present disclosure may be implemented.

FIG. 1 illustrates an exemplary ballast regulator machine 10 in which automated ballast wing storage and deployment in accordance with the present disclosure may be implemented. The ballast regulator machine 10 is configured to travel along rail tracks and groom the ballast supporting the tracks and ties (not shown). The ballast regulator machine 10 may include a regulator frame 12 mounted on wheels 14 (only front left shown) that are driven by a power source (not shown) such as an internal combustion engine, electric motor or the like. A pair of plow blades 16 (one shown) may be movably mounted at a front end of the regulator frame 12. The plow blades 16 may articulate as necessary to sculpt the ballast to the proper height and spread it evenly along the tracks and ties as the ballast regulator machine 10 travels along the rails. Controls for operating the plow blades 16 and other components of the ballast regulator machine 10 may be located within an operator cab 18.

The ballast regulator machine 10 as illustrated in FIG. 1 includes a pair of ballast wings 20 pivotally mounted to either side of the regulator frame 12 rearward of the plow blades 16. The right ballast wing 20 is shown in a stowed position where the ballast wing 20 is closed, retracted and rotated up against the right side of the regulator frame 12. In contrast, the left ballast wing 20 is shown in a deployed position where it is rotated away from the left side of the regulator frame 12, extended and open. In the deployed position, the left ballast wing 20 is ready to groom the ballast on the corresponding side of the track.

Each of the ballast wings 20 has a similar configuration operated in a similar manner. The following discussion details components of the left ballast wing 20, but applies equally to the right ballast wing 20. The ballast wing 20 includes a wing arm 22 pivotally connected to the regulator frame 12 to rotate between the stowed position of the right ballast wing 20 and the lowered position of the left ballast wing 20. A wing lift cylinder 24 is mounted between the regulator frame 12 and the wing arm 22 such that the wing lift cylinder 24 is extended to lower the ballast wing 20 and retracted to raise the ballast wing 20. The wing arm 22 may include a telescoping wing arm extension 26 that may be extended and retracted to move the ballast wing 20 away from and toward the regulator frame 12, respectively. A wing extension cylinder 28 is mounted between the wing arm 22 and the wing arm extension 26 such that the wing extension cylinder 28 is extended to extend the wing arm extension 26 and retracted to retract the wing arm extension 26.

Figure 2:
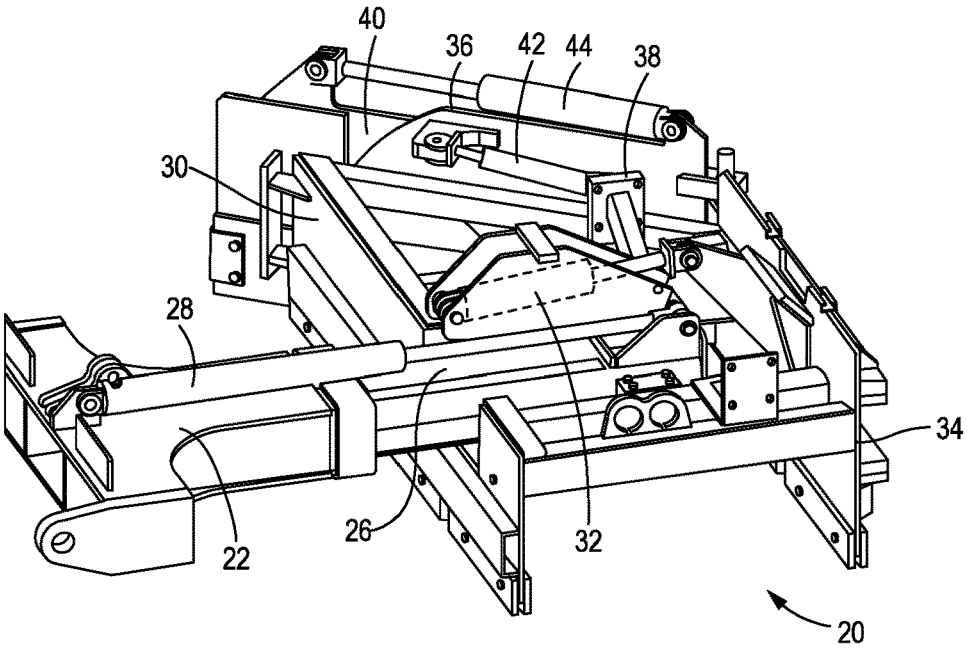
FIG. 2 is an isometric view of a portion of a ballast wing of the ballast regulator machine of FIG. 1.

A wing frame 30 may be pivotally mounted to an outboard end of the wing arm extension 26. Referring to FIG. 2 that illustrates the left ballast wing 20 with a forward portion of the ballast wing 20 removed for clarity of illustration, the pivotal connection of the wing frame 30 to the wing arm extension 26 may provide a rotational axis that is approximately parallel to a rotational axis of the wing arm 22 and to the track over which the ballast regulator machine 10 travels. The position of the wing frame 30 relative to the wing arm extension 26 may be controlled by a wing pivot cylinder 32 mounted between the wing arm extension 26 and the wing frame 30. The wing pivot cylinder 32 may be extended to pivot an upper edge of an outer door 34 of the wing frame 30 away from the regulator frame 12 and retracted to pivot the upper edge of the outer door 34 toward the regulator frame 12.

The wing frame 30 functions as a support structure for the components of the ballast wing 20 that articulate into positions to groom the ballast. The outer door 34 (FIGS. 1 and 2) is mounted at the outboard end of the wing frame 30. Articulating template assemblies 36 are mounted at leading and trailing edges of the outer door 34. Each of the template assemblies 36 may include a template mounting plate 38 and a template grooming plate 40 pivotally connected to the template mounting plate 38. The template mounting plate 38 may be pivotally connected to a corresponding end of the outer door 34 for rotation toward and away from the wing frame 30. A template open/close cylinder 42 (FIG. 2) may be connected between the wing frame 30 and the template mounting plate 38 such that extension of the template open/close cylinder 42 rotates the template assembly 36 away from the wing frame 30 toward a template open position, and retraction of the template open/close cylinder 42 rotates the template assembly 36 toward the wing frame 30 and a template closed position. The template assembly 36 further includes a template articulation cylinder 44 connected between the template mounting plate 38 and the template grooming plate 40. The template articulation cylinder 44 may be extended to rotate the template grooming plate 40 downward relative to the template mounting plate 38 and the outer door 34, and may be retracted to rotate the template grooming plate 40 upward. This configuration allows the leading and trailing template assemblies 36 of each ballast wing 20 to have rotational movement about two axes to position the template grooming plates 40 as necessary to groom the ballast.

Figure 3:
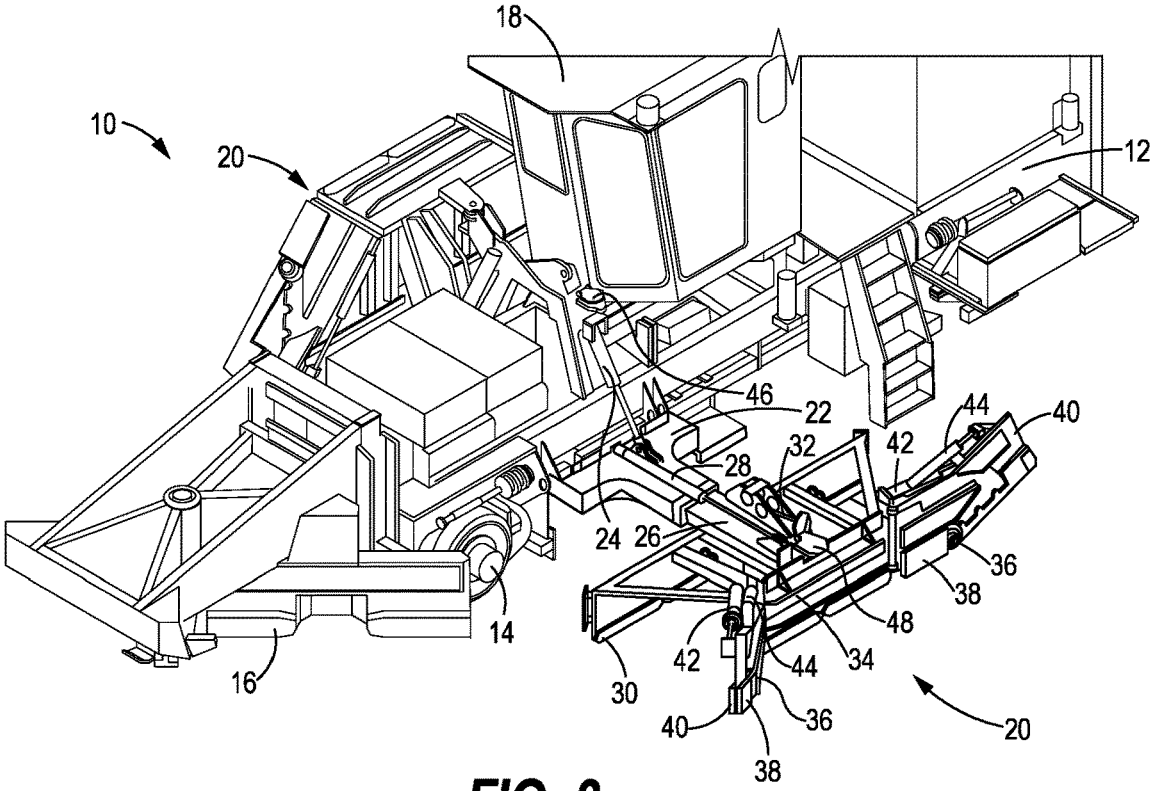
FIG. 3 is the isometric view of the ballast regulator machine of FIG. 1 with a wing arm of the ballast wing moved to a safe zone.

An exemplary sequence for safely retracting the ballast wings 20 from the deployed position of FIG. 1 to the stowed position is illustrated in FIGS. 3-8. In the initial position of FIG. 1, the wing arm 22 has been rotated past horizontal to a downward angle, the template assemblies 36 are rotated from their template closed positions, and the template grooming plates 40 are rotated upward. As an initial step, the wing lift cylinder 24 may be partially retracted to raise the wing arm 22 and the wing frame 30 upward away from the ballast and into a safe zone as illustrated in FIG. 3 where other components of the ballast wing 20 can be manipulated without interference from the ballast. The safe zone for the wing arm 22 may be at least horizontal or above horizontal. In some embodiments, the safe zone maybe an angle within a range from horizontal to approximately 45° above horizontal.

Figure 4:
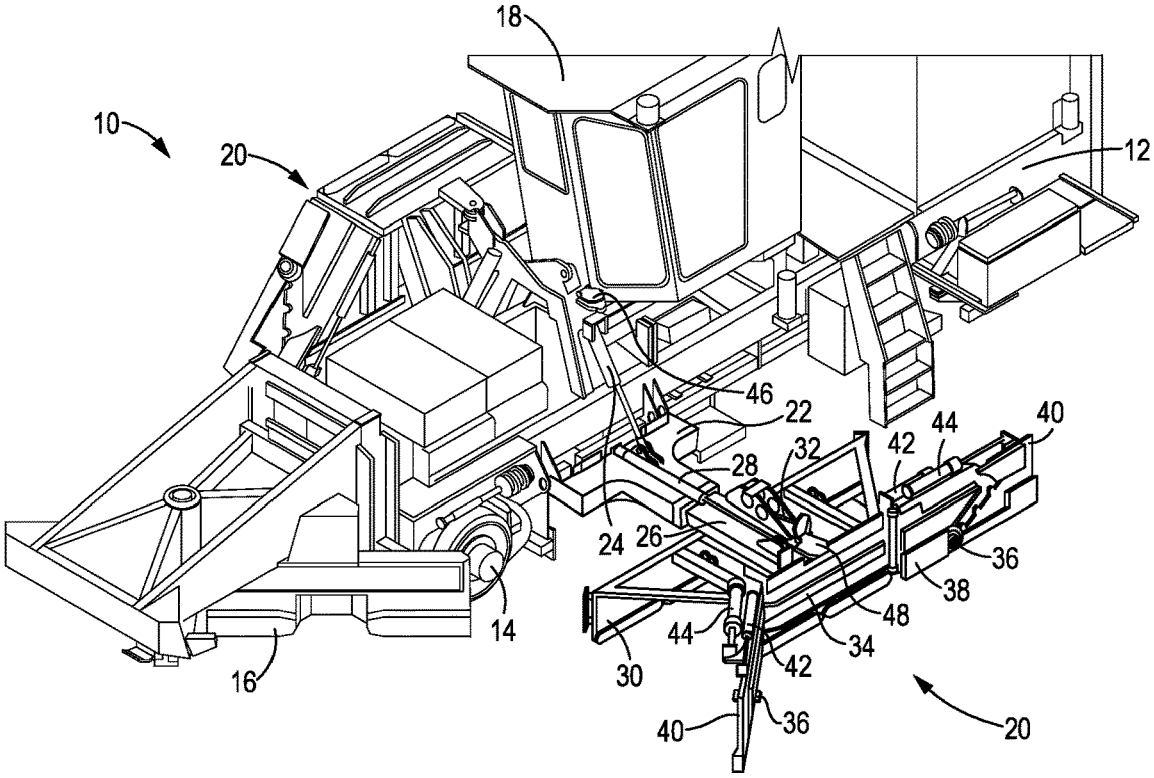
FIG. 4 is the isometric view of the ballast regulator machine of FIG. 1 with template grooming plates of the ballast wing extended horizontally.
Figure 5:
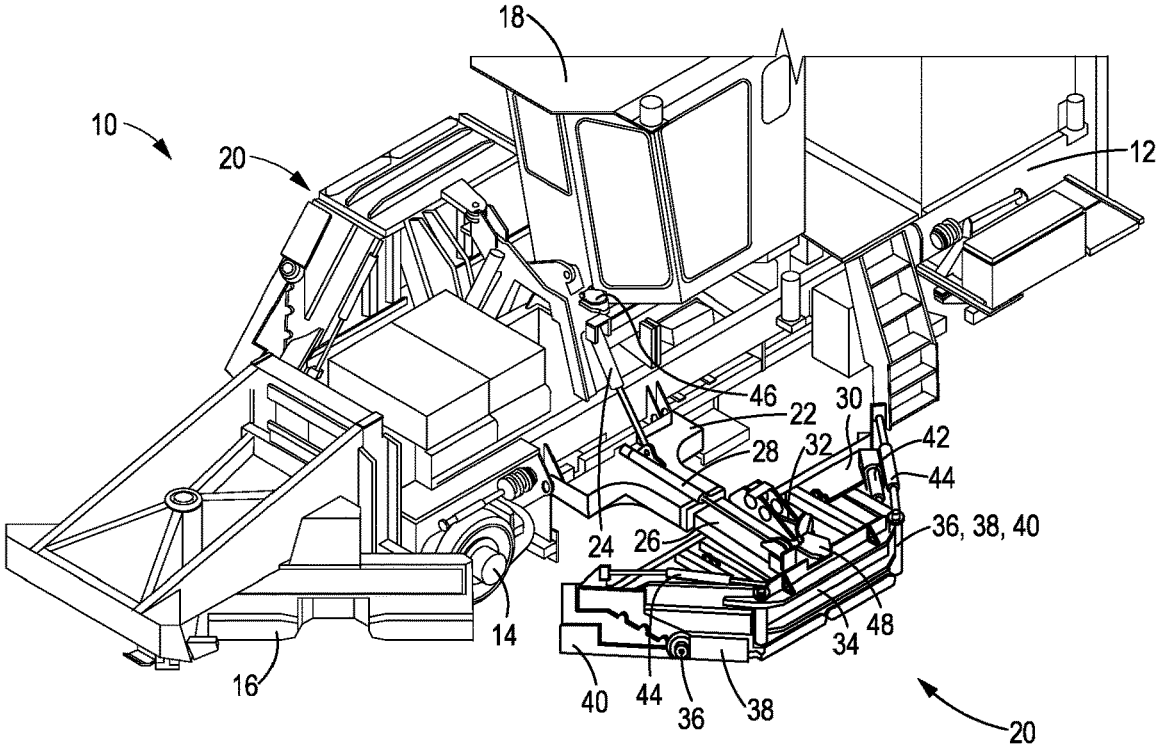
FIG. 5 is the isometric view of the ballast regulator machine of FIG. 1 with template assemblies of the ballast wing rotated to template closed positions.
Figure 6:
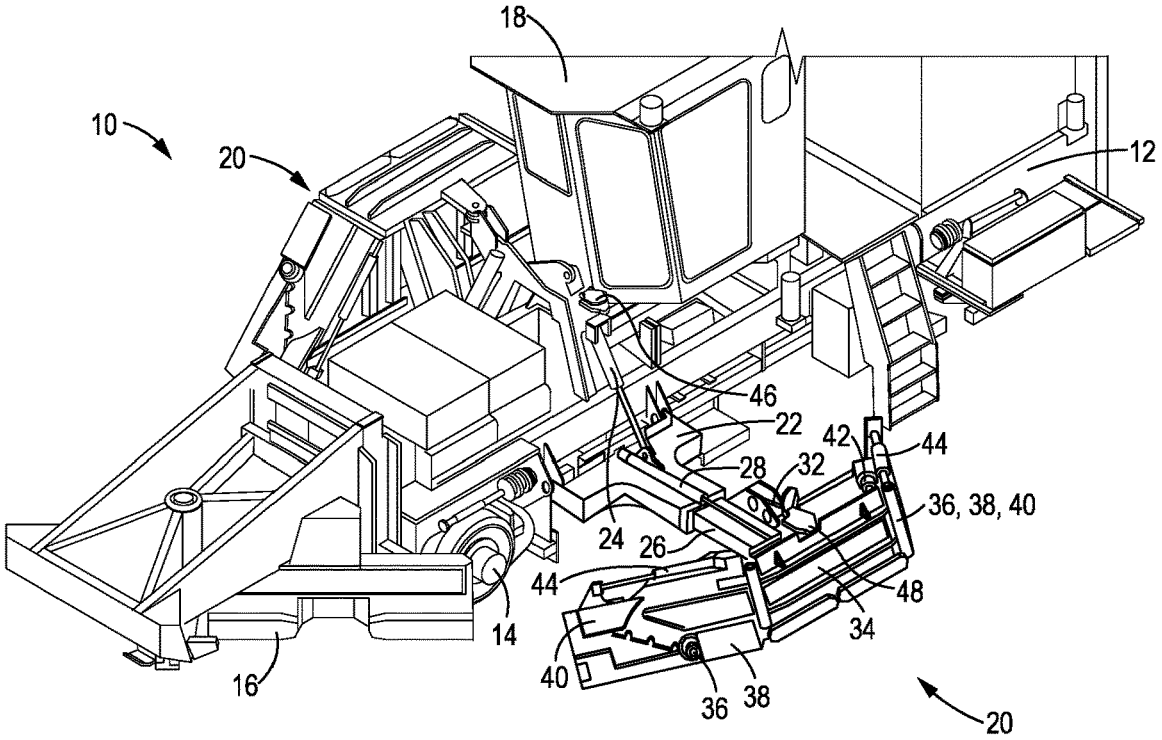
FIG. 6 is the isometric view of the ballast regulator machine of FIG. 1 with a wing frame of the ballast wing rotated to a wing frame stored position.
Figure 7:
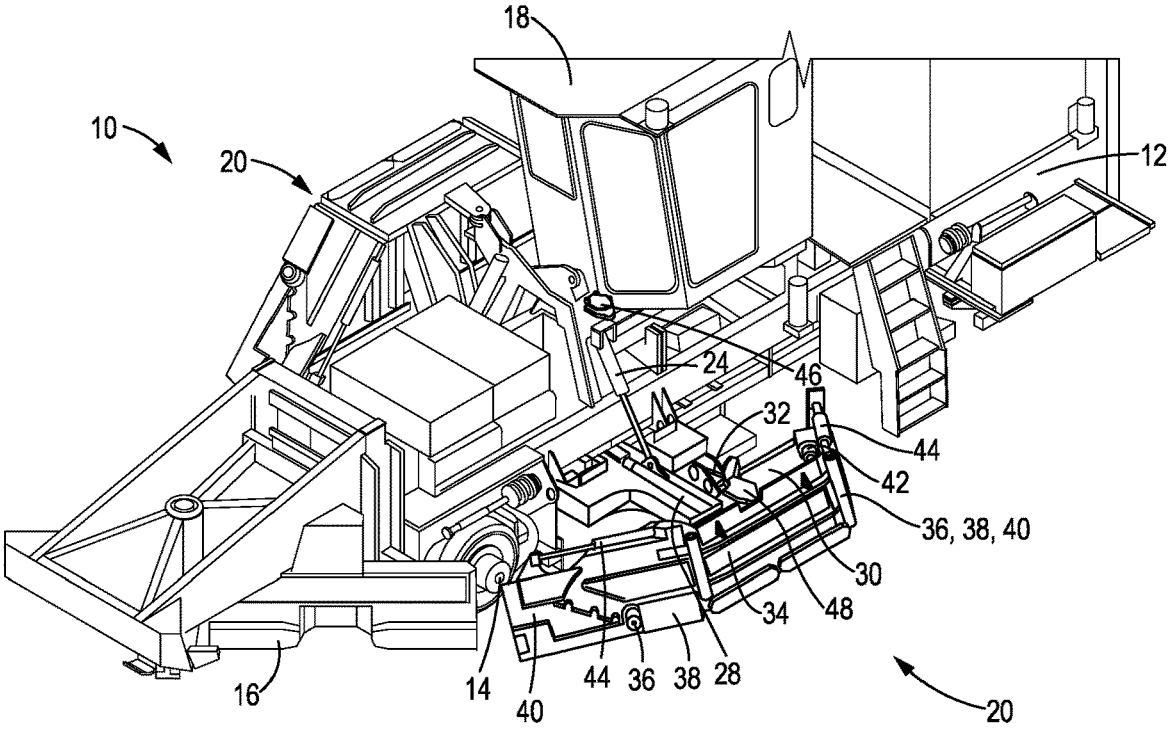
FIG. 7 is the isometric view of the ballast regulator machine of FIG. 1 with a wing arm extension of the ballast wing retracted.

After the wing arm 22 is rotated into the safe zone of FIG. 3, the template assemblies 36 may be prepared for storage as shown in FIGS. 4 and 5. Referring to FIG. 4, the template articulation cylinders 44 maybe actuated to extend or retract as may be necessary so that the template grooming plates 40 extend horizontally outward away from the outer door 34. After the template grooming plates 40 are extended, the template open/close cylinders 42 may be retracted until the template assemblies 36 are rotated toward the wing frame 30 to the template closed positions illustrated in FIG. 5. After the template assemblies 36 are closed, the wing pivot cylinder 32 may be retracted to rotate the wing frame 30 to a wing frame stored position as shown in FIG. 6, followed by the wing extension cylinder 28 being retracted to retract the wing arm extension 26 and draw the wing frame 30 toward the regulator frame 12 as shown in FIG. 7.

Figure 8:
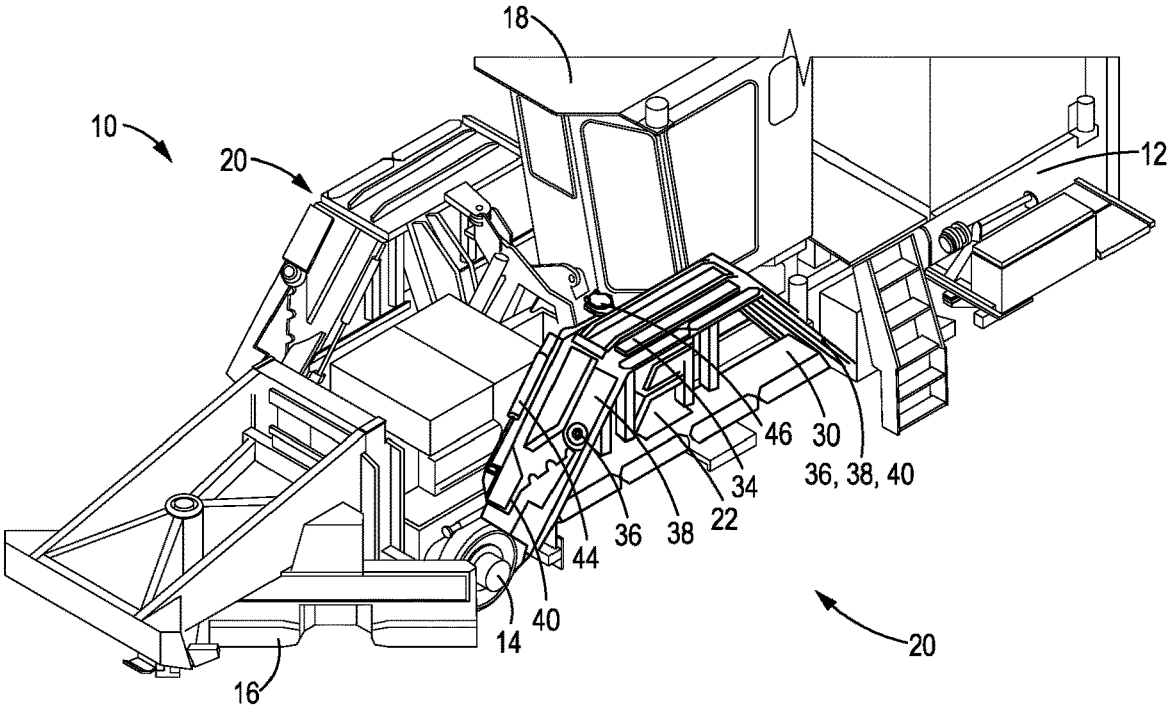
FIG. 8 is the isometric view of the ballast regulator machine of FIG. 1 with the ballast wing rotated to a stowed position.

After the wing arm extension 26 is retracted, the wing lift cylinder 24 is again actuated to retract and rotate the wing arm 22 and the wing frame 30 to the fully retracted and stowed position shown in FIG. 8. Each ballast wing 20 may further include a locking mechanism to secure the ballast wing 20 in the stowed position. Referring back to FIG. 1, the locking mechanism may include a wing lock 46 mounted to the regulator frame 12 proximate the wing lift cylinder 24, and a lock receiver 48 mounted at a top edge of the outer door 34. As the ballast wing 20 rotates into the stowed position of FIG. 8, the lock receiver 48 moves into position relative to the wing lock 46 such that the wing lock 46 may be actuated to engage the lock receiver 48 to secure the ballast wing 20 in the stowed position.

Figure 9:
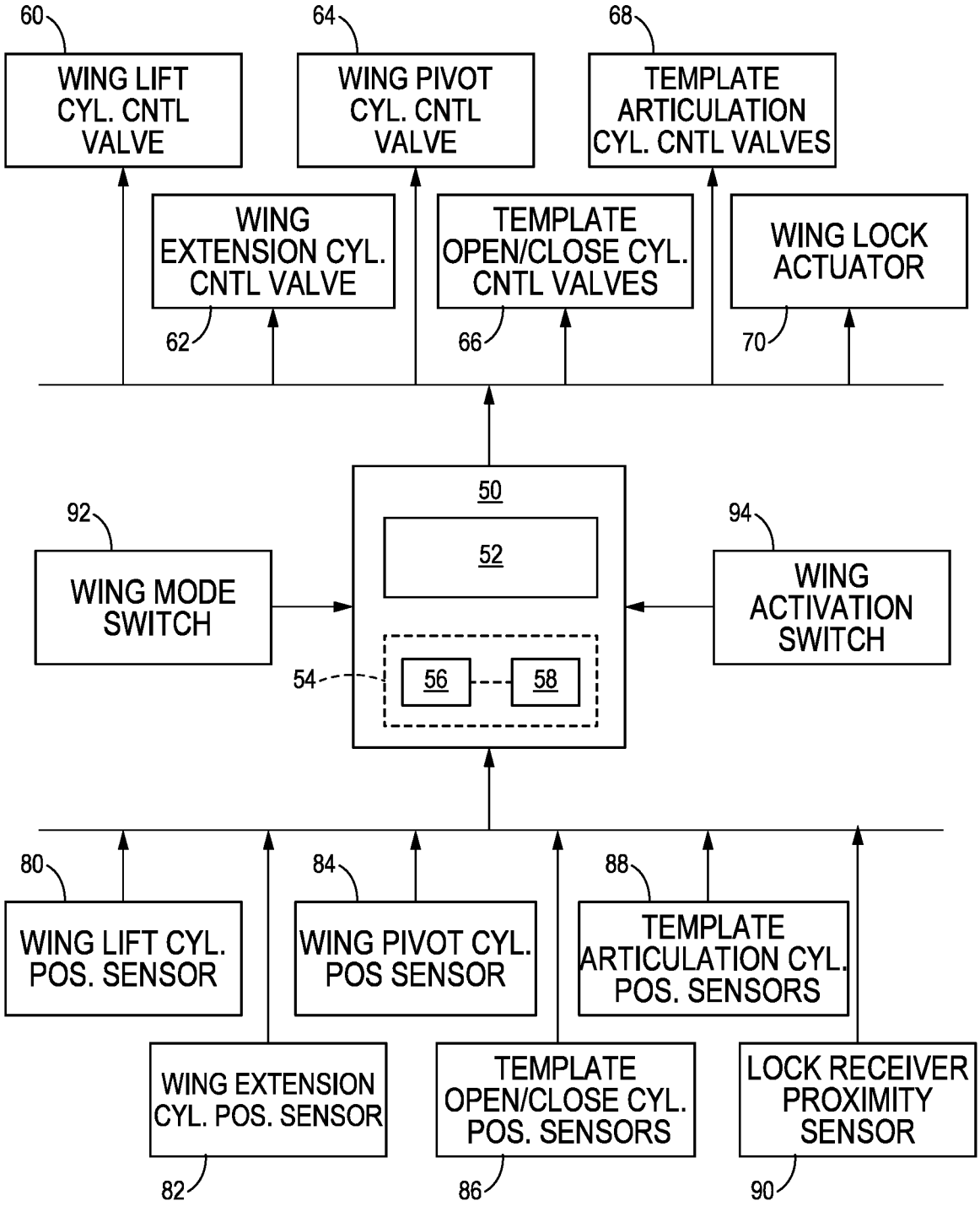
FIG. 9 is a schematic view of operational and control system components of the ballast regulator machine of FIG. 1 pertaining to automated ballast wing storage and deployment in accordance with the present disclosure.

Referring now to FIG. 9, exemplary operational components and control system components of the ballast regulator machine 10 pertaining to automated control of storage and deployment of the ballast wings 20 in accordance with the present disclosure are illustrated. A machine controller 50 may be provide in the ballast regulator machine 10 to control the execution of the automated storage and deployment of the ballast wings 20 among other control functions of the ballast regulator machine 10. The machine controller 50 may include a microprocessor 52 for executing a specified program, which controls and monitors various functions associated with the ballast regulator machine 10. The microprocessor 52 includes a memory 54, such as read only memory (ROM) 56, for storing a program or programs, and a random access memory (RAM) 58 which serves as a working memory area for use in executing the program(s) stored in the memory 54. Although the machine controller 50 is shown, it is also possible and contemplated to use other electronic components such as a microcontroller, an ASIC (application specific integrated circuit) chip, or any other integrated circuit device.

While the discussion provided herein relates to the stowage and deployment of the ballast wings 20, the machine controller 50 is typically configured to control other aspects of operation of other systems of the ballast regulator machine 10. Moreover, the machine controller 50 may refer collectively to multiple control and processing devices across which the functionality of the machine leak detection system and other operational systems of the ballast regulator machine 10 may be distributed. For example, in autonomous or semi-autonomous ballast regulator machines 10, portions of the functionality discussed herein may be performed at remote computing devices or monitoring locations that are operatively connected to the machine controller 50 by a communication module (not shown) of the ballast regulator machine 10. The remote computing devices or monitoring locations may be in a centralized location for an enterprise utilizing the ballast regulator machines 10 to perform maintenance of rail lines. The remote computing devices or monitoring locations may be operatively connected to exchange information as necessary to control and monitor the operation of the ballast regulator machine 10. Other variations in consolidating and distributing the processing of the machine controller 50 as described herein are contemplated as having use in machine leak detection systems in accordance with the present disclosure.

The machine controller 50 is operatively connected to the operational components of the ballast regulator machine 10 to the extent that the operational components are controlled by the machine controller 50 or provide data to the machine controller 50 for monitoring and control of the ballast regulator machine 10. Those skilled in the art will be familiar with the exchange of information and control signals between the machine controller 50 and the operational components to control the operation of the operational components and the functioning of the ballast regulator machine 10 without the necessity of further elaboration herein except as necessary to describe automated stowage and deployment of the ballast wings 20 in accordance with the present disclosure.

The machine controller 50 may be configured to transmit control signals to various output devices of the ballast regulator machine 10. Each of the cylinders 24, 28, 32, 42, 44 may be a hydraulic or pneumatic cylinder where the flow of a fluid such as oil, water, air or the like is controlled to extend, retract or lock in place the cylinders 24, 28, 32, 42, 44. Flow control may be performed by control devices or actuators such as control valves that are actuatable in response to control signals to move to corresponding positions for fluid flow to operate the cylinders 24, 28, 32, 42, 44 as commanded. Those skilled in the art will understand that other types of actuators may be implemented that can control movement of the cylinders 24, 28, 32, 42, 44 between extended and retracted positions. Consequently, the cylinders 24, 28, 32, 42, 44 for each ballast wing 20 may have a wing lift cylinder actuator 60, a wing extension cylinder actuator 62, a wing pivot cylinder actuator 64, a template open/close cylinder actuator 66 and a template articulation cylinder actuator 68, respectively, that are operatively connected to the machine controller 50. The memory 54 of the machine controller 50 may store automated stowage and deployment programs that are executed by the machine controller 50 that cause the machine controller 50 to transmit control signals to the actuators 60-68 to operate the cylinders 24, 28, 32, 42, 44 and move the components of the ballast wings 20 in specified sequences. In addition to the actuators 60-68, the machine controller 50 may be operatively connected to a wing lock actuator 70 of the wing lock 46 that is actuatable to cause the wing lock 46 move between locked and unlocked position to alternately engage and disengage the lock receiver 48.

The machine controller 50 may also be configured to receive signals from various input devices of the ballast regulator machine 10 such as sensors and operator controls. To properly sequence the movement of the components to stow or deploy the ballast wings 20, it may be necessary to monitor the position of the components at the onset of stowage or deployment and during the process. The positions or states of the corresponding cylinders 24, 28, 32, 42, 44 provide indications of relative positions of the components to which the cylinders 24, 28, 32, 42, 44 are connected. In the illustrated embodiment, the cylinders 24, 28, 32, 42, 44 for each ballast wing 20 may have a wing lift cylinder position sensor 80, a wing extension cylinder position sensor 82, a wing pivot cylinder position sensor 84, a template open/close cylinder position sensor 86 and a template articulation cylinder position sensor 88, respectively, that are operatively connected to the machine controller 50. The position sensors 80-88 transmit sensor signals to the machine controller 50 that are indicative of the positions of the corresponding cylinders 24, 28, 32, 42, 44, and the machine controller 50 may use the sensor signals as inputs during execution of the automated deployment and stowage programs.

The particular position sensor may be determined based on the information required by the machine controller 50 for each of the cylinders 24, 28, 32, 42, 44. For some of the cylinders 24, 28, 32, 42, 44, it may be necessary to know the absolute linear position of the cylinder at any point along its stroke between the fully extend and fully retracted positions. For example, it may be necessary to know the absolute linear position of the wing lift cylinder 24 to determine whether the wing arm 22 is within the safe zone, or to know the absolute linear positions of the template articulation cylinders 44 to determine whether the template grooming plates 40 are extending horizontally. The position of a cylinder such as the wing pivot cylinder 32 may also be required to ensure that components are positioned to groom the ballast. Consequently, the cylinders 24, 32, 44 may have corresponding linear position sensors, such as linear variable differential transformer (LVDT) sensors, to provide sensor signals indicating an absolute linear position of the associated cylinder. For other cylinders 24, 28, 32, 42, 44, it may only be necessary to know when the cylinder has reached a final position. For example, for the wing extension cylinder 28 and the template open/close cylinders 42, it may only be required to know when the wing arm extension 26 is fully retracted and the template assemblies 36 are fully closed. In these positions, engagement between the connected components resists further retraction of the cylinders 28, 42, thereby causing a pressure increase at the cylinders 28, 42. For these cylinders 28, 42, the position sensors 82, 86 may be pressure sensors transmitting sensor signals to the machine controller 50 indicative of fluid pressures within the cylinders 28, 42, and the machine controller 50 may determine that the cylinders 28, 42 are fully retracted when the pressures in the sensor signals exceed predetermine maximum cylinder pressures. The position sensors described herein are exemplary, and those skilled in the art will understand that any appropriate sensors may be used to detect relevant positions of the cylinders 24, 28, 32, 42, 44 and transmit sensor signals to the machine controller 50 for automated stowage and deployment control of the ballast wings 20 in accordance with the present disclosure.

The proximity of the lock receiver 48 to the wing lock 46 may be derived based on the information from the position sensors 80-88 and the corresponding positions of the cylinders 24, 28, 32, 42, 44 and other components of the ballast wings 20. However, it may be desirable or necessary to provide redundancy by also having a direct measurement of the proximity of the lock receiver 48 to the wing lock 46. The backup or failsafe measurement may ensure proper engagement of the components and avoid damaging the lock components 46, 48 if they are misaligned. Consequently, a lock receiver proximity sensor 90 may be operatively connected to the machine controller 50 and transmit sensor signals indicative of the proximity of the lock receiver 48 to the wing lock 46.

The machine controller 50 may be operatively connected to input devices within the operator cab 18 for control of the operations of the ballast regulator machine 10. For each ballast wing 20, the operator cab 18 may have control devices (not shown) for manually adjusting the positions of the ballast wing 20 and its components. Relative to automate stowage and deployment of the ballast wings 20, the operator cab 18 may include a wing mode switch 92 operatively connected to the machine controller 50. In one embodiment, the wing mode switch 92 may be a three-position switch having a neutral position where the ballast wing 20 is to be maintained in its current position, a storage mode position for commanding stowage of the ballast wing 20, and a deploy mode position for commanding deployment of the ballast wing 20. The wing mode switch 92 may transmit corresponding input signals to the machine controller 50 in the storage and deploy mode positions, and may not transmit signals in the neutral position. The operator cab 18 may further include a wing activation switch 94 operatively connected to the machine controller 50. The wing activation switch 94 may be a two-position switch with an off position where no signals are transmitted to the machine controller 50, and an on position where signals are transmitted to the machine controller 50. The machine controller 50 may be programmed to interpret signals from the switches 92, 94 together to control execution of the automated storage and deployment programs. Upon detecting signals indicating that the wing activation switch 94 is in the on position, the machine controller 50 may evaluate signals from the wing mode switch 92 to determine the mode to be executed. If the wing mode switch 92 is in the neutral position, the machine controller 50 will not execute either program. Otherwise, the machine controller 50 will execute the program commended by the position of the wing mode switch 92.

Figure 10:
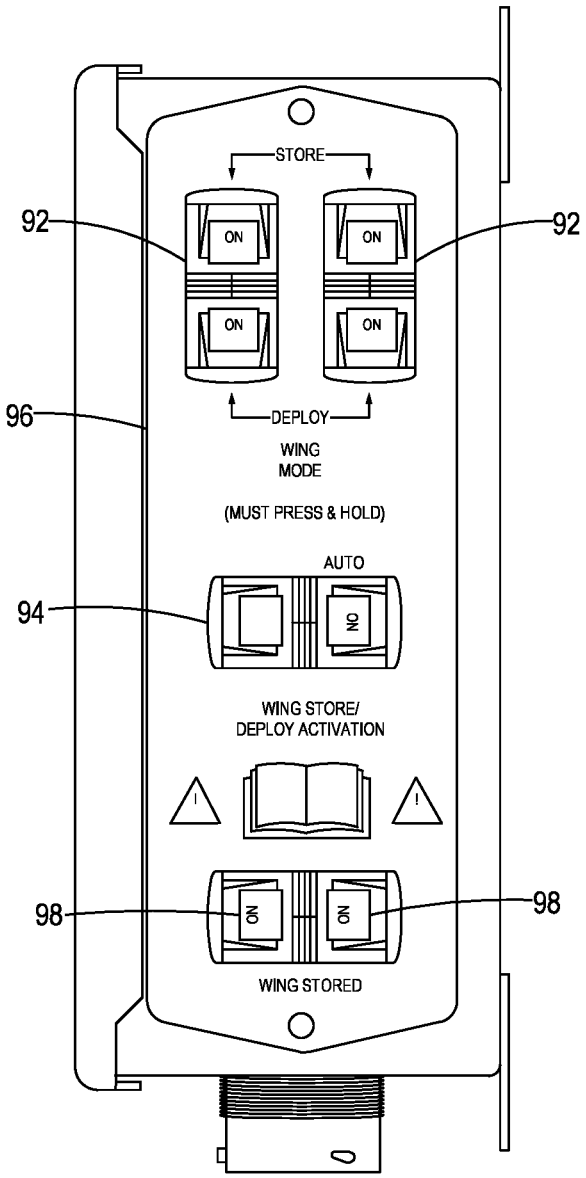
FIG. 10 is a top view of an exemplary switch array for control of automated ballast wing storage and deployment in accordance with the present disclosure.

FIG. 10 illustrates an embodiment of wing mode switches 92 and the wing activation switch 94 implemented within the operator cab 18. The arrangement may be installed in a switch array 96 on an operator panel or integrated into the operator seat for convenient access. Wing mode switches 92 for each of the ballast wings 20 may be provided along with a single wing activation switch 94. The wing mode switches 92 may be operated independently so that the ballast wings 20 may be automatically operated at the same time or one at a time. Consequently, when the wing activation switch 94 is pressed to the on position, each of the ballast wings 20 will be automatically stowed, automatically deploy, or remain in position based on the current position of the corresponding wing mode switch 92. The switch array 96 may further include wing storage status lights 98 that may be operatively connected to the machine controller 50. In response to determining that one of the ballast wings 20 is in the stored position, the machine controller 50 may transmit signals to cause the corresponding wing storage status light 98 to illuminate.

INDUSTRIAL APPLICABILITY

Figure 11:
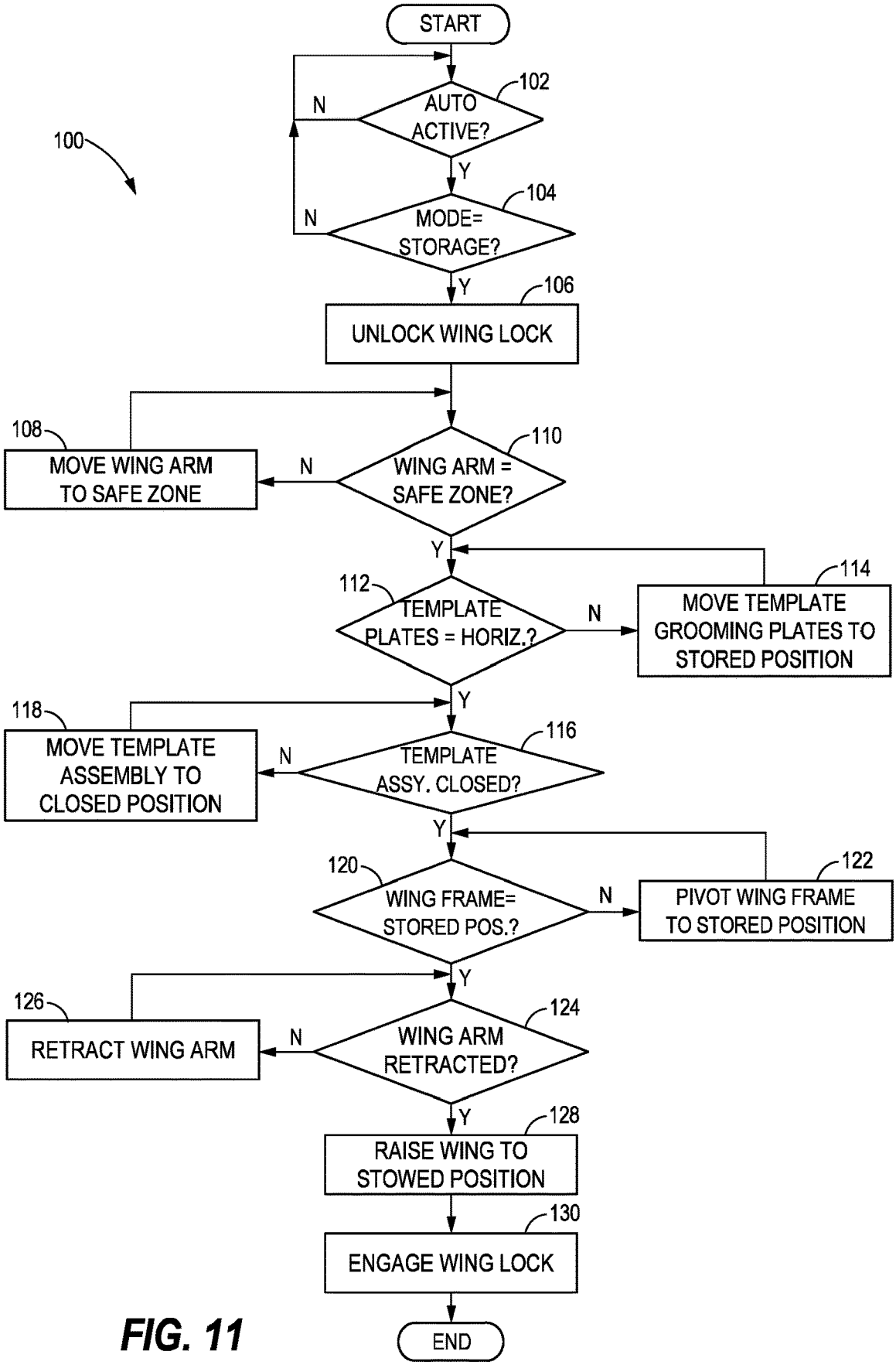
FIG. 11 is a flow diagram of an exemplary automated ballast wing storage routine in accordance with the present disclosure.

As discussed above, the memory 54 of the machine controller 50 may store automated storage and deployment programs that are executed by the machine controller 50 to control the ballast wings 20. FIG. 11 illustrates an exemplary automated ballast wing storage routine 100 that may be programmed into and executed by the machine controller 50. The routine 100 may begin at a block 102 where the machine controller 50 evaluates input signals from the wing activation switch 94 to determine whether an operator is activating automated control of one or both ballast wings 20. If the machine controller 50 determines that the operator is not activating automated control, control passes back to the block 102 to continue monitoring for actuation of the wing activation switch 94.

If the machine controller 50 determines that the operator is activating automated control at the block 102, control may pass to a block 104 where the machine controller 50 evaluates input signals from the wing mode switch or switches 92 to determine whether they are set to the storage mode position. If no wing mode switch 92 is in the storage mode position, control may pass back to the block 102 to continue monitoring for automated control actuation at the wing activation switch 94 and the storage mode position at the wing mode switches 92. If the machine controller 50 determines that one or more wing mode switch 92 is in the storage mode position, control may pass to a block 106 where the machine controller 50 may transmit control signals to the wing lock actuator 70 to cause the wing lock 46 to move to an unlocked position in preparation for receiving the lock receiver 48 when the ballast wing 20 moves to the stowed position.

After the wing lock 46 is unlocked at the block 106, control may pass to a block 108 where the machine controller 50 may evaluate the sensor signals from the wing lift cylinder position sensor 80 to determine whether the wing arm 22 is positioned within the predetermined safe zone as shown, for example, in FIG. 3. As discussed above, the wing lift cylinder position sensor 80 may be an absolute linear position sensor that provides sensor signals indicative of the position of the wing lift cylinder 24 along its stroke. If the machine controller 50 determines that the wing arm 22 is not within the safe zone, control may pass to a block 110 where the machine controller 50 transmits control signals to the wing lift cylinder actuator 60 to extend or retract the wing lift cylinder 24 as necessary to move the wing arm 22 into the safe zone. After causing the wing lift cylinder 24 to move the wing arm 22 to the safe zone, control may pass back to the block 108 for the machine controller 50 to determine whether the wing arm 22 is now positioned in the safe zone.

Once the machine controller 50 determines that the wing arm 22 is in the safe zone, control may pass to a block 112 where the machine controller 50 may evaluate the sensor signals from the template articulation cylinder position sensors 88 to determine whether the template grooming plates 40 are oriented horizontally in the position shown in FIG. 4. If the machine controller 50 determines that the template grooming plates 40 are not horizontal, control may pass to a block 114 where the machine controller 50 transmits control signals to the template articulation cylinder actuators 68 to extend or retract the template articulation cylinders 44 as necessary to move the template grooming plates 40 to horizontal positions. After causing the template articulation cylinders 44 to move the template grooming plates 40 to horizontal positions, control may pass back to the block 112 for the machine controller 50 to determine whether the template grooming plates 40 are not oriented horizontally.

After the machine controller 50 determines that the template grooming plates 40 are oriented horizontally, control may pass to a block 116 where the machine controller 50 may evaluate the sensor signals from the template open/close cylinder position sensors 86 to determine whether the template assemblies 36 are in the template closed positions against the wing frame 30 as shown in FIG. 5. If the machine controller 50 determines that the template assemblies 36 are not in the template closed positions, control may pass to a block 118 where the machine controller 50 transmits control signals to the template open/close cylinder actuators 66 to retract the template open/close cylinders 42 as necessary to move the template assemblies 36 to the template closed positions. After causing the template open/close cylinders 42 to move the template assemblies 36 to the template closed positions, control may pass back to the block 116 for the machine controller 50 to determine whether the template assemblies 36 are in the template closed positions, such as when the sensor signals from the template open/close cylinder position sensors 86 indicate a pressure spike caused by the template assemblies 36 engaging the wing frame 30.

Once the machine controller 50 determines that the template assemblies 36 are in the template closed positions, control may pass to a block 120 where the machine controller 50 may evaluate the sensor signals from the wing pivot cylinder position sensor 84 to determine whether the wing frame 30 is in the wing frame stored position shown in FIG. 6. If the machine controller 50 determines that the wing frame 30 is not in the wing frame stored position, control may pass to a block 122 where the machine controller 50 transmits control signals to the wing pivot cylinder actuator 64 to retract the wing pivot cylinder 32 to move the wing frame 30 to the wing frame stored position. After causing the wing pivot cylinder 32 to move the wing frame 30 to the wing frame stored position, control may pass back to the block 120 for the machine controller 50 to determine whether the wing frame 30 is in the wing frame stored position.

After the machine controller 50 determines that the wing frame 30 is in the wing frame stored position, control may pass to a block 124 where the machine controller 50 may evaluate the sensor signals from the wing extension cylinder position sensor 82 to determine whether the wing arm extension 26 is retracted into the wing arm 22 as shown in FIG. 7. If the machine controller 50 determines that the wing arm extension 26 not in retracted, control may pass to a block 126 where the machine controller 50 transmits control signals to the wing extension cylinder actuator 62 to retract the wing extension cylinder 28 as necessary to retract the wing arm extension 26 into the wing arm 22. After causing the wing extension cylinder 28 to retract the wing arm extension 26, control may pass back to the block 124 for the machine controller 50 to determine whether the wing arm extension 26 is fully retracted, such as when the sensor signals from the wing extension cylinder position sensor 82 indicates a pressure spike caused by the wing arm extension 26 or the wing frame 30 engaging the wing arm 22.

When the wing arm extension 26 is fully retracted, the ballast wing 20 is ready for final rotation into the stowed position as shown in FIG. 8. Control may pass to a block 128 where the machine controller 50 transmits control signals to the wing lift cylinder actuator 60 to retract the wing lift cylinder 24 as necessary to rotate the ballast wing 20 to the stowed position. The machine controller 50 may continue to monitor the sensor signals from the wing lift cylinder actuator 60 until the ballast wing 20 is in disposed proximate the regulator frame 12. Once the ballast wing 20 is in the stowed position, control may pass to a block 130 where the machine controller 50 transmits control signals to the wing lock actuator 70 to engage the wing lock 46 to the lock receiver 48 if the sensor signals from the lock receiver proximity sensor 90 indicates that the lock receiver 48 is in position relative to the wing lock 46. The machine controller 50 may also transmit control signals to turn on the corresponding wing storage status light 98.

Figure 12:
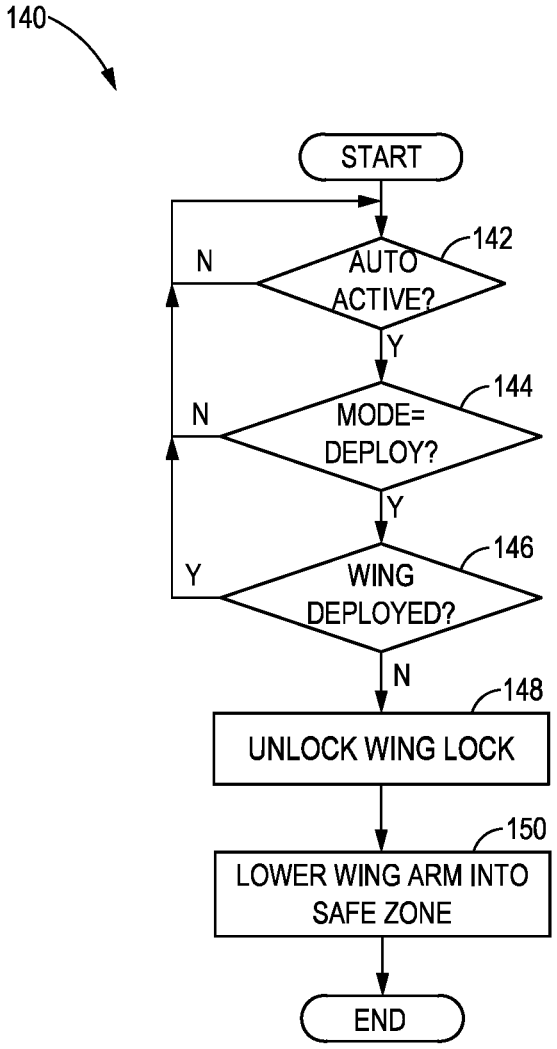
FIG. 12 is a flow diagram of an exemplary automated ballast wing deployment routine in accordance with the present disclosure.

FIG. 12 illustrates an exemplary automated ballast wing deployment routine 140 that may be programmed into and executed by the machine controller 50 to deploy the ballast wings 20 from their stowed positions. The routine 140 may begin at a block 142 where the machine controller 50 evaluates input signals from the wing activation switch 94 in a similar manner as the block 102 to determine whether an operator is activating automated control of one or both ballast wings 20. If the machine controller 50 determines that the operator is not activating automated control, control passes back to the block 142 to continue monitoring for actuation of the wing activation switch 94.

If the machine controller 50 determines that the operator is activating automated control at the block 142, control may pass to a block 144 where the machine controller 50 evaluates input signals from the wing mode switch or switches 92 to determine whether they are set to the deploy mode position. If no wing mode switch 92 is in the deploy mode position, control may pass back to the block 142 to continue monitoring for automated control actuation at the wing activation switch 94 and the deploy mode position at the wing mode switches 92. If the machine controller 50 determines that one or more wing mode switch 92 is in the deploy mode position, control may pass to a block 146 where the machine controller 50 may determine whether the ballast wing 20 is already in a deployed position. The machine controller 50 may evaluate the sensor signals from the various position sensors 80-88 and the lock receiver proximity sensor 90 to determine whether the ballast wing 20 is currently in the stowed position or in a deployed position. In some embodiments, the machine controller 50 may store information regarding the current position of the ballast wings 20, such as values of the sensor signals or a ballast wing position status, in the memory 54, and retrieve the information at the block 146 to determine whether the ballast wing 20 is deployed. If the machine controller 50 determines that the ballast wing 20 is already deployed at the block 146, control may pass back to the block 142 to continue monitoring for automated control actuation at the wing activation switch 94 and the deploy mode position at the wing mode switches 92.

If the machine controller 50 determines that the ballast wing 20 is not already deployed at the block 146, control may pass to a block 148 where the machine controller 50 may transmit control signals to the wing lock actuator 70 to cause the wing lock 46 to disengage the lock receiver 48 and unlock the ballast wing 20. After the wing lock 46 is unlocked at the block 148, the ballast wing 20 is ready to be rotated downward with the wing arm 22 disposed within the safe zone as shown in FIG. 7. Control may pass to a block 150 where the machine controller 50 transmits control signals to the wing lift cylinder actuator 60 to extend the wing lift cylinder 24 as necessary to rotate the ballast wing 20 away from the regulator frame 12 and the stowed position toward the safe zone. The machine controller 50 may continue to monitor the sensor signals from the wing lift cylinder actuator 60 until the wing arm 22 is disposed within the safe zone. At the same time, the machine controller 50 may transmit signals to turn off the wing storage status light 98. Once the wing arm 22 is positioned in the safe zone, the routine 140 may terminate so that the operator can adjust the configuration of the ballast wing 20 in preparation for grooming the ballast.

The apparatus and methods for automated storage and deployment of the ballast wings 20 in accordance with the present disclosure facilitate safe movement of the components of the ballast wings 20 to avoid damage to the ballast wings 20 and objects in proximity to the ballast regulator machine 10. This control of certain movements of the ballast wings 20 can be beneficial to both inexperienced and experienced operators of the ballast regulator machine 10. As the routines 100, 140 are executed by the machine controller 50, other safety precautions may operate in the background. For example, placing one of the wing mode switches 92 in either the storage mode position or the deploy mode position may cause joysticks or other operator input devices for the ballast wings 20 to be disable to prevent transmission of conflicting control signals to the machine controller 50. Further, the storage or deployment sequence may be stopped if the wing activation switch 94 is released by the operator. In some embodiments, the sequence may restart if the operator presses the wing activation switch 94 within a specified time period. Otherwise, the interrupted sequence must be restarted from the beginning. In this way, the risk of damage to the ballast wings 20 and the ballast regulator machine 10 can be minimized.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A ballast regulator machine comprising:

a regulator frame;

a ballast wing comprising:

a wing arm pivotally mounted to the regulator frame, a wing arm extension movably mounted to the wing arm for extension away from and retraction toward the regulator frame, a wing frame pivotally mounted to an end of the wing arm extension opposite the regulator frame, a wing lift cylinder having a wing lift cylinder actuator and connected between the regulator frame and the wing arm, a wing pivot cylinder having a wing pivot cylinder actuator and connected between the wing arm extension and the wing frame, and a wing extension cylinder having a wing extension cylinder actuator and connected between the wing arm and the wing arm extension, a wing activation switch;

a machine controller operatively connected to the wing lift cylinder actuator, the wing pivot cylinder actuator, the wing extension cylinder actuator and the wing activation switch, wherein the machine controller is programmed to:

detect actuation of the wing activation switch, actuate the wing lift cylinder actuator to cause the wing lift cylinder to dispose the wing arm within a predetermined safe zone in response to detecting actuation of the wing activation switch, actuate the wing pivot cylinder actuator to cause the wing lift cylinder to rotate the wing frame to a wing frame stored position after the wing arm is within the predetermined safe zone, actuate the wing extension cylinder actuator to cause the wing extension cylinder to retract the wing arm extension to a retracted position after the wing frame is in the wing frame stored position, and actuate the wing lift cylinder actuator to cause the wing lift cylinder to rotate the ballast wing to a stored position adjacent the regulator frame after the wing arm extension is in the retracted position;

a wing lock mounted on the regulator frame and having a wing lock actuator operative connected to the machine controller, wherein the machine controller is programmed to actuate the wing lock actuator to cause the wing lock to engage the ballast wing after the ballast wing is rotated to the stored position.

2. The ballast regulator machine of claim 1, wherein the ballast wing comprises:

a template assembly pivotally mounted to the wing frame and rotatable between a template closed position with the template assembly disposed adjacent the wing frame and a template open position with the template assembly disposed remote from the wing frame; and a template open/close cylinder having a template open/close cylinder actuator and connected between the template assembly and the wing frame, wherein the template open/close cylinder actuator is operatively connected to the machine controller, wherein the machine controller is programmed to actuate the template open/close cylinder to rotate the template assembly to the template closed position after the wing arm is positioned within the predetermined safe zone and before the wing frame is rotated to the wing frame stored position.

3. The ballast regulator machine of claim 2, wherein the template assembly comprises:

a template mounting plate pivotally mounted to the wing frame;

a template grooming plate pivotally mounted to the template mounting plate; and a template articulation cylinder having a template articulation cylinder actuator and connected between the template mounting plate and the template grooming plate, wherein the template articulation cylinder actuator is operatively connected to the machine controller, wherein the machine controller is programmed to actuate the template articulation cylinder actuator to rotate the template grooming plate to a horizontal position after the wing arm is positioned within the predetermined safe zone and before the template assembly is rotated to the template closed position.

4. The ballast regulator machine of claim 1, comprising a wing mode switch operatively connected to the machine controller and having a storage mode position, wherein the machine controller is programmed to:

determine a switch position of the wing mode switch in response to detecting actuation of the wing activation switch; and actuate the wing lift cylinder actuator to dispose the wing arm within the predetermined safe zone in response to detecting actuation of the wing activation switch and determining that the switch position of the wing mode switch is the storage mode position.

5. The ballast regulator machine of claim 1, wherein the ballast regulator machine comprises a lock receiver proximity sensor mounted on the regulator frame and operatively connected to the machine controller, wherein the ballast wing comprises a lock receiver mounted on the wing frame, and wherein the machine controller is programmed to actuate the wing lock actuator to cause the wing lock to engage the lock receiver after the ballast wing is rotated to the stored position and the lock receiver proximity sensor indicates that the lock receiver is disposed proximate the wing lock.

6. The ballast regulator machine of claim 1, wherein the predetermined safe zone for the wing arm is within a range from a horizontal position to a position 45° above horizontal.

7. A method for automated storage of a ballast wing of a ballast regulator machine, wherein the ballast regulator machine includes a regulator frame, and wherein the ballast wing includes a wing arm pivotally mounted to the regulator frame, a wing arm extension movably mounted to the wing arm for extension away from and retraction toward the regulator frame, and a wing frame pivotally mounted to an end of the wing arm extension opposite the regulator frame, the method for automated storage comprising:

detecting, by a machine controller of the ballast regulator machine, actuation of a wing activation switch;

actuating, by the machine controller, a wing lift cylinder connected between the regulator frame and the wing arm to dispose the wing arm within a predetermined safe zone in response to detecting actuation of the wing activation switch;

actuating, by the machine controller, a wing pivot cylinder connected between the wing arm extension and the wing frame to rotate the wing frame to a wing frame stored position after the wing arm is within the predetermined safe zone;

actuating, by the machine controller, a wing extension cylinder connected between the wing arm and the wing arm extension to retract the wing arm extension to a retracted position after the wing frame is in the wing frame stored position; and actuating, by the machine controller, the wing lift cylinder to rotate the ballast wing to a stored position adjacent the regulator frame after the wing arm extension is in the retracted position, wherein the ballast wing includes a template assembly pivotally mounted to the wing frame and rotatable between a template closed position with the template assembly disposed adjacent the wing frame and a template open position with the template assembly disposed remote from the wing frame, and where the method for automated storage comprises actuating, by the machine controller, a template open/close cylinder connected between the template assembly and the wing frame to rotate the template assembly to the template closed position after the wing arm is positioned within the predetermined safe zone and before the wing frame is rotated to the wing frame stored position.

8. The method for automated storage of claim 7, wherein the template assembly includes a template mounting plate pivotally mounted to the wing frame and a template grooming plate pivotally mounted to the template mounting plate, and where the method for automated storage comprises actuating, by the machine controller, a template articulation cylinder connected between the template mounting plate and the template grooming plate to rotate the template grooming plate to a horizontal position after the wing arm is positioned within the predetermined safe zone and before the template assembly is rotated to the template closed position.

9. The method for automated storage of claim 7, comprising:

determining, by the machine controller, a switch position of a wing mode switch in response to detecting actuation of the wing activation switch; and actuating, by the machine controller, the wing lift cylinder to dispose the wing arm within the predetermined safe zone in response to detecting actuation of the wing activation switch and determining that the switch position of the wing mode switch is a storage mode position.

10. The method for automated storage of claim 7, wherein the ballast regulator machine includes a wing lock mounted on the regulator frame, and wherein the method for automated storage comprises actuating, by the machine controller, the wing lock to engage the ballast wing after the ballast wing is rotated to the stored position.

11. The method for automated storage of claim 10, wherein the ballast regulator machine includes a lock receiver proximity sensor mounted on the regulator frame and the ballast wing includes a lock receiver mounted on the wing frame, and wherein the method for automated storage comprises actuating, by the machine controller, the wing lock to engage the lock receiver after the ballast wing is rotated to the stored position and the lock receiver proximity sensor indicates that the lock receiver is disposed proximate the wing lock.

12. The method for automated storage of claim 7, wherein the predetermined safe zone for the wing arm is within a range from a horizontal position to a position 45° above horizontal.

13. A ballast regulator machine comprising:

a regulator frame;

a ballast wing comprising:

a wing arm pivotally mounted to the regulator frame, a wing arm extension movably mounted to the wing arm for extension away from and retraction toward the regulator frame, a wing frame pivotally mounted to an end of the wing arm extension opposite the regulator frame, a wing lift cylinder having a wing lift cylinder actuator and a wing lift cylinder position sensor, and connected between the regulator frame and the wing arm, a wing pivot cylinder having a wing pivot cylinder actuator and a wing pivot cylinder position sensor, and connected between the wing arm extension and the wing frame, and a wing extension cylinder having a wing extension cylinder actuator and a wing extension cylinder position sensor, and connected between the wing arm and the wing arm extension, a wing activation switch; and a machine controller operatively connected to the wing lift cylinder actuator, the wing lift cylinder position sensor, the wing pivot cylinder actuator, the wing pivot cylinder position sensor, the wing extension cylinder actuator, the wing extension cylinder position sensor and the wing activation switch, wherein the machine controller is programmed to:

detect actuation of the wing activation switch, actuate the wing lift cylinder actuator to cause the wing lift cylinder to dispose the wing arm within a predetermined safe zone as indicated by the wing lift cylinder position sensor in response to detecting actuation of the wing activation switch, actuate the wing pivot cylinder actuator to cause the wing lift cylinder to rotate the wing frame to a wing frame stored position as indicated by the wing pivot cylinder position sensor after the wing arm is within the predetermined safe zone, actuate the wing extension cylinder actuator to cause the wing extension cylinder to retract the wing arm extension to a retracted position as indicated by the wing extension cylinder position sensor after the wing frame is in the wing frame stored position, and actuate the wing lift cylinder actuator to cause the wing lift cylinder to rotate the ballast wing to a stored position adjacent the regulator frame as indicated by the wing lift cylinder position sensor after the wing arm extension is in the retracted position, wherein the wing lift cylinder position sensor comprises a linear position sensor that transmits sensor signals indicating an absolute linear position of the wing lift cylinder.

14. The ballast regulator machine of claim 13, wherein the wing extension cylinder position sensor comprises a pressure sensor the transmits sensor signals indicating a fluid pressure within the wing extension cylinder, and wherein the retracted position of the wing arm extension is indicated when the fluid pressure within the wing extension cylinder is greater than a predetermined maximum wing extension cylinder pressure.

15. The ballast regulator machine of claim 13, wherein the wing pivot cylinder position sensor comprises a linear position sensor that transmits sensor signals indicating an absolute linear position of the wing pivot cylinder.

16. The ballast regulator machine of claim 13, wherein the ballast wing comprises:

a template assembly pivotally mounted to the wing frame and rotatable between a template closed position with the template assembly disposed adjacent the wing frame and a template open position with the template assembly disposed remote from the wing frame; and a template open/close cylinder having a template open/close cylinder actuator and a template open/close cylinder position sensor, and connected between the template assembly and the wing frame, wherein the template open/close cylinder actuator and the template open/close cylinder position sensor are operatively connected to the machine controller, wherein the machine controller is programmed to actuate the template open/close cylinder to rotate the template assembly to the template closed position as indicated by the template open/close cylinder position sensor after the wing arm is positioned within the predetermined safe zone and before the wing frame is rotated to the wing frame stored position.

17. The ballast regulator machine of claim 16, wherein the template assembly comprises:

a template mounting plate pivotally mounted to the wing frame;

a template grooming plate pivotally mounted to the template mounting plate; and a template articulation cylinder having a template articulation cylinder actuator and a template articulation cylinder position sensor, and connected between the template mounting plate and the template grooming plate, wherein the template articulation cylinder actuator and the template articulation cylinder position sensor are operatively connected to the machine controller, wherein the machine controller is programmed to actuate the template articulation cylinder actuator to rotate the template grooming plate to a horizontal position as indicated by the template articulation cylinder position sensor after the wing arm is positioned within the predetermined safe zone and before the template assembly is rotated to the template closed position.

* * * * *